US012281270B2

(12) United States Patent
Harvey et al.

(10) Patent No.: US 12,281,270 B2
(45) Date of Patent: Apr. 22, 2025

(54) SUSTAINABLE TURBINE AND DIESEL FUELS FROM ISOPRENE AND α OLEFINS

(71) Applicant: The United States of America, as represented by the Secretary of the Navy, Arlington, VA (US)

(72) Inventors: Benjamin G. Harvey, Ridgecrest, CA (US); Calvin Luke Keller, Ridgecrest, CA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 18/736,352

(22) Filed: Jun. 6, 2024

(65) Prior Publication Data

US 2024/0409833 A1 Dec. 12, 2024

Related U.S. Application Data

(60) Provisional application No. 63/506,513, filed on Jun. 6, 2023.

(51) Int. Cl.
*C10L 1/04* (2006.01)

(52) U.S. Cl.
CPC ..... *C10L 1/04* (2013.01); *C10L 2200/0469* (2013.01); *C10L 2290/543* (2013.01)

(58) Field of Classification Search
CPC ..... C10L 1/04; C10L 2200/0469; C10L 2290/543
See application file for complete search history.

(56) References Cited

U.S. PATENT DOCUMENTS

2014/0221258 A1* 8/2014 Ohler ..... C10M 107/14 508/110

* cited by examiner

*Primary Examiner* — Ellen M McAvoy
*Assistant Examiner* — Ming Cheung Po
(74) *Attorney, Agent, or Firm* — Naval Air Warfare Center Weapons Division; Edu Enin-Okut

(57) ABSTRACT

The invention relation to an efficient, high-throughput method for converting isoprene and α-olefins to sustainable fuels and fuel blendstocks. The method includes coupling biologically-derived isoprene and α-olefins via hydrovinylation to generate heavier acyclic hydrocarbons, and hydrogenating the acyclic hydrocarbons to produce sustainable fuel and fuel blendstocks. The sustainable fuels and fuel blendstocks produced by this method have applications that include use as both aviation and diesel fuels and fuel blendstocks.

15 Claims, 5 Drawing Sheets

SUSTAINABLE TURBINE AND DIESEL FUELS FROM ISOPRENE AND α OLEFINS

CROSS-REFERENCE TO RELATED APPLICATIONS

This application is a non-provisional application claiming the benefit of U.S. provisional application No. 63/506,513, filed on Jun. 6, 2023, the contents of which are hereby expressly incorporated by reference in its entirety and which priority is claimed.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF INVENTION

The invention generally relates to a high-throughput method for the conversion of isoprene and α-olefins to sustainable fuels and fuel blendstocks.

BACKGROUND

As a critical resource for modern society, billions of gallons of jet fuel are consumed worldwide every year. Conventional jet fuel is derived from non-renewable petroleum, and the combustion of these fuels is a significant contributor to atmospheric $CO_2$ levels and global warming. In addition, petroleum-based fuels contain aromatic compounds which can generate particulates that increase radiative forcing and, in turn, increase global warming beyond their impact of increasing $CO_2$ concentration in the atmosphere.

SUMMARY

To address these challenges, the method described herein is an efficient, high-throughput process for converting biologically-derived isoprene and α-olefins into sustainable, clean-burning, full-performance fuels and fuel blendstocks. The fuels produced have lower viscosities and higher gravimetric heats of combustion compared to conventional petroleum-based jet fuel, and do not contain aromatic compounds which results in enhanced combustion efficiency and reduced coke formation. In addition, modest chain branching of these fuels results in high cetane numbers, allowing for their use as a sustainable fuel alternative in diesel engines.

Definitions

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Reference throughout the specification to "one example", "another example", "an example", and so forth, means that a particular element (e.g., feature, structure, and/or characteristic) described in connection with the example is included in at least one example described below, and may or may not be present in other examples. In addition, it is to be understood that the described elements for any example may be combined in any suitable manner in the various examples unless the context clearly dictates otherwise.

In describing and claiming the examples described below, the singular forms "a", "an", and "the" include plural referents unless the context clearly dictates otherwise.

As used herein, the terms "about" or "approximately" mean within an acceptable range for the particular parameter specified as determined by one of ordinary skill in the art, which will depend in part on how the value is measured or determined, e.g., the limitations of the sample preparation and measurement system. Example of such limitations include preparing the sample in wet versus a dry environment, different instruments, variations in sample height, and differing requirements in signal-to-noise ratios. The use of numerical values in the various ranges specified in this application, unless expressly indicated otherwise, are stated as approximations as though the minimum and maximum values within the stated ranges are both preceded by the word "about" or "approximately". In this manner, slight variations above and below the stated ranges can be used to achieve substantially the same results as values within the ranges. Also, unless indicated otherwise, the disclosure of these ranges is intended as a continuous range including every value between the minimum and maximum values.

The definitions and understandings of fuels and fuel blendstocks are known to those of skill in the art, and such definitions are incorporated herein for the purposes of understanding the general nature of the subject matter of the present application. However, the following discussion is useful as a further understanding of some of these terms.

DETAILED DESCRIPTION

Renewable fuels based on acyclic hydrocarbons typically have densities that are below the specifications for common jet fuels such as Jet-A, JP-5, and JP-8. The efficient, high-throughput method described below provides for the conversion of biologically derived isoprene and α-olefins for the sustainable production of heavier, acyclic hydrocarbon fuels and fuel blendstocks, such as high-performance synthetic paraffinic kerosenes (SPKs), with applications both jet fuel and diesel fuel.

Figure 1:
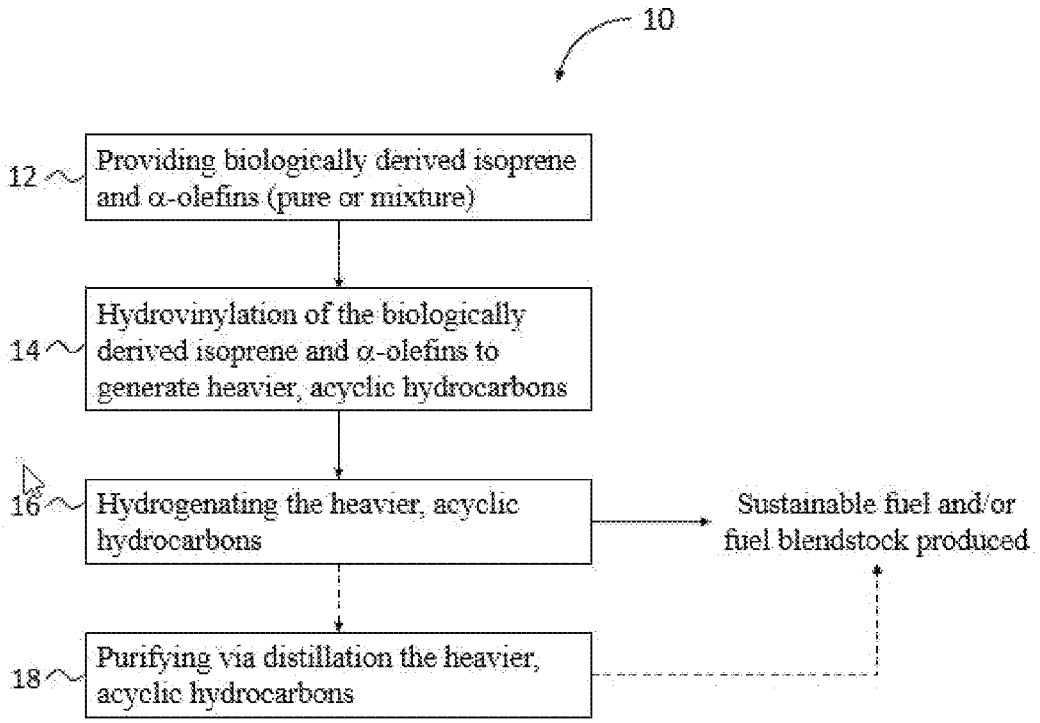
FIG. 1 is a flow diagram depicting an example of the method for converting isoprene and α-olefins to sustainable fuels and fuel blendstocks.
Figure 2:
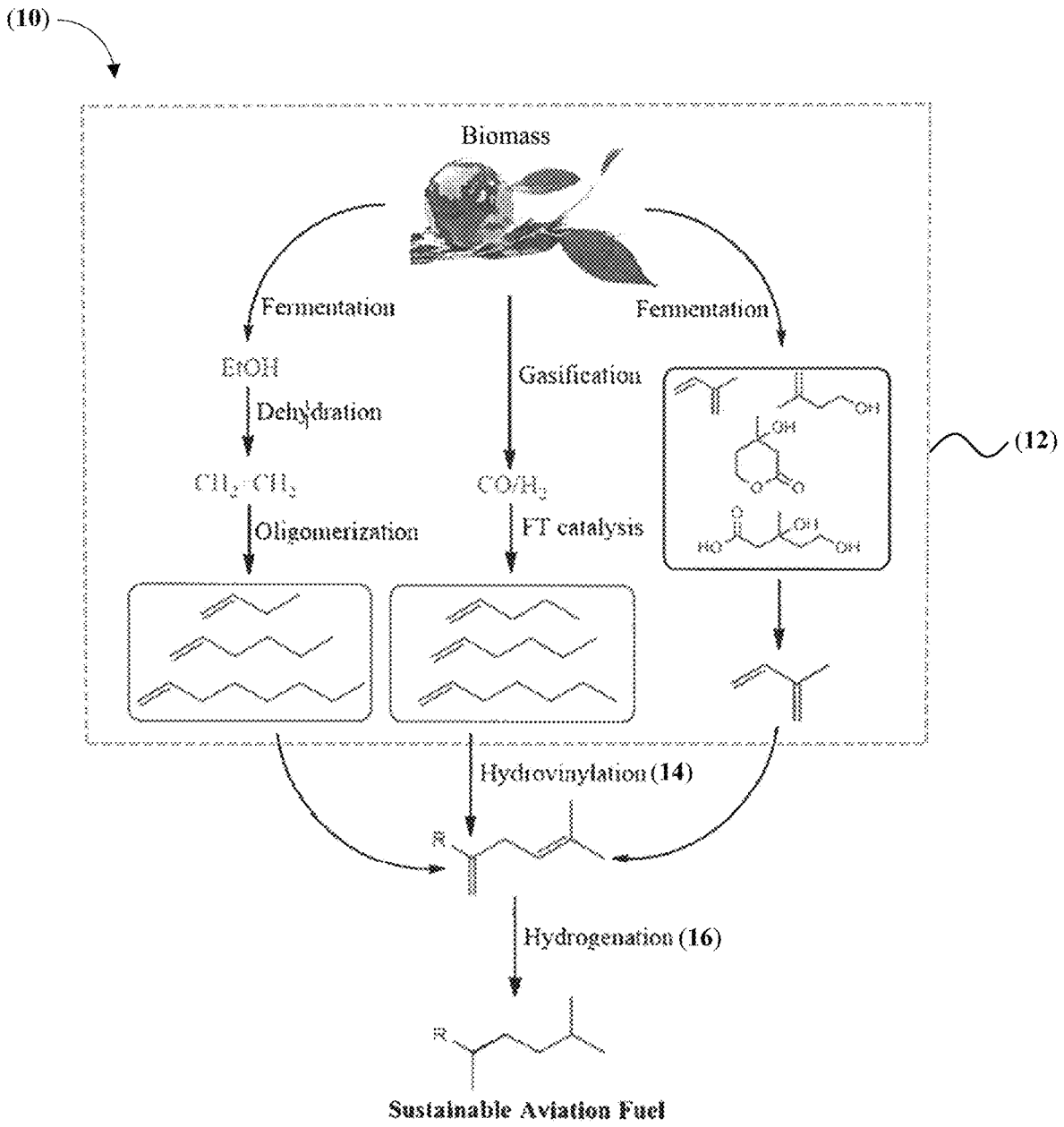
FIG. 2 is a schematic depicting an example of the method for converting a biologically-derived isoprene and α-olefin mixture to a sustainable aviation fuel (SAF).

An example of the method is illustrated in FIG. 1. The method 10 to synthesize fuels and fuel blendstocks from isoprene and α-olefins begins at step 12 by providing biologically derived isoprene and α-olefins, where the α-olefins are composed of a pure α-olefin or a mixture of α-olefins. Next, at step 14, a hydrovinylation reaction couples the isoprene to the α-olefins which generates heavier, acyclic hydrocarbons, that is, an alkene or a mixture of alkenes ($C_{10}$ or greater). The acyclic hydrocarbons are subjected to hydrogenation at step 16. The hydrogenation of the acyclic hydrocarbons can directly result in the production of a sustainable fuel or fuel blendstock such as the production of a sustainable aviation fuel (SAF) depicted in FIG. 2. If any impurities are introduced during processing, and/or a mixture of α-olefins are used, the hydrogenated acyclic hydrocarbons can undergo an additional step 18 of purification by distillation. The mixture of hydrogenated acyclic hydrocarbons generated when a mixture of α-olefins is used can be separated by distillation into fractions. Each distillate fraction may be useful as a sustainable fuel or fuel blendstock.

Although the isoprene and α-olefins used in the method can be obtained from petrochemical sources, isoprene and α-olefins derived from biological sources are preferred in order to produce fuels and fuel blendstocks that are sustainable. For example, biologically derived isoprene suitable for use in the method can be generated from a fermentation process, or from intermediates including isoprenol, isoprenyl acetate, mesaconic acid, itaconic acid, and mevalonolactone. Suitable α-olefins include a single component (e.g., 1-hexene), branched chain components, or a mixture of components. An even numbered α-olefin, or mixture of even-numbered α-olefins, can be generated from ethanol by dehydration to ethylene followed by oligomerization. A mixture of even and odd-numbered α-olefins can be generated via Fischer-Tropsch catalysis of a biomass-derived syngas. Examples of α-olefins useful in the method include an α-olefins such as 1-propene, 1-butene, 1-pentene, 1-hexene, 1-heptene, 1-octene, 1-nonene, 1-decene, 1-undecene, 1-dodecene, and mixtures thereof.

Figure 3:
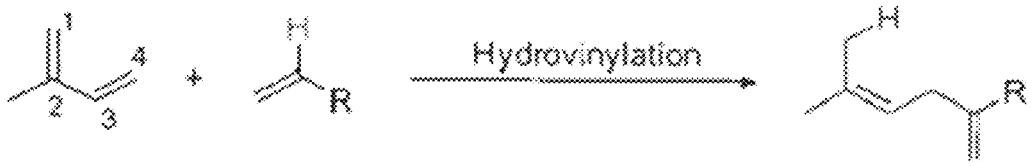
FIG. 3 is a schematic depicting an example of hydrovinylation of isoprene with α-olefins, where R is an alkyl group.

In the hydrovinylation reaction, the α-olefins can undergo 1,4-addition to isoprene with coupling through the 2-position of the α-olefins in the presence of one or more transition metal catalysts, as shown in FIG. 3. Preferably, the transition metal catalysts are cobalt-based catalysts. Examples of suitable cobalt-based catalysts include catalysts with a cobalt metal center ligated with phosphine ligands, such as cobalt (II) bromide DPPE complex ($CoBr_2$(DPPE)), that may be reduced with a zinc metal. The hydrovinylation reaction can be conducted with catalyst loadings as low as 0.1 mole percent (mol %) in standard grade solvents, rather than anhydrous solvents. The heavier, acyclic hydrocarbons produced from the hydrovinylation reaction (i.e., pure alkenes or a mixture of alkenes) can include 2-methyl-5-methylene-2-nonene, 3-methyl-5-methylenenon-2-ene, 2-methyl-5-methylene-2-octene, 3-methyl-5-methyleneoct-2-ene, 2-methyl-5-methylene-2-decene, 3-methyl-5-methylenedec-2-ene, 2-methyl-5-methylene-2-undecene, and 3-methyl-5-methylencundec-2-enc.

Figure 4:
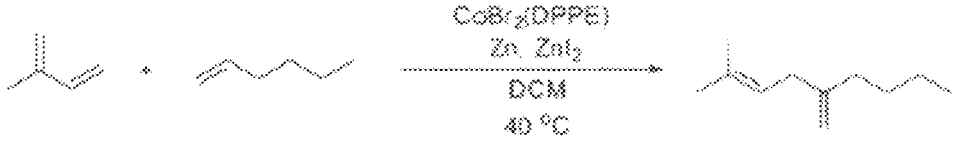
FIG. 4 is a schematic depicting the hydrovinylation of isoprene with a single α-olefin, 1-hexene.

An example of hydrovinylation using isoprene and 1-hexene proceeded using a $CoBr_2$ (DPPE), generated in situ, with zinc as the reducing agent. The reaction was heated at 40° C. for 18 hours, generating 2-methyl-5-methylene-2-nonene as the primary product through coupling at the 4-position on isoprene as shown in FIG. 4. In addition to the primary product, one significant side product, 3-methyl-5-methylene-2-nonene, was also produced through coupling at the 1-position of isoprene. A few trace products were observed by gas chromatography, but they represented less than 1% of the total reaction yield.

Hydrogenation of the heavier, acyclic hydrocarbons can be achieved by placing them under a pressurized hydrogen atmosphere in the presence of a catalyst. The catalyst may be based on nickel (Ni), iron (Fc), cobalt (Co), palladium (Pd), and platinum (Pt). For example, hydrogenation of the heavier hydrocarbons can occur under using a 10% Pd/C catalyst at 200° C. and 650 psi for 16 hours. Examples of the hydrogenated acyclic hydrocarbons produced include compounds such as 2,5-dimethylnonane, 3,5-dimethylnonane, 2,5-dimethyloctane, 3,5-dimethyloctane, 2,5-dimethyldecane, 3,5-dimethyldecane, 2,5-dimethylundecane, and 3,5-dimethylundecane.

Purification of the hydrogenated acyclic hydrocarbons can be accomplished by distillation. If a mixture of α-olefins is provided at the beginning of the method, then different distillate cuts can be taken to generate a number of distillate fractions useful as either jet fuel or diesel fuel. If heavier α-olefins are provided (e.g., Cis and greater) at the beginning of the method, then heavier distillate fractions useful as lubricants can also be recovered via the distillation process. Examples of the compounds obtained after distillation include 2,5-dimethylnonane, 3,5-dimethylnonane, 2,5-dimethyloctane, 3,5-dimethyloctane, 2,5-dimethyldecane, 3,5-dimethyldecane, 2,5-dimethylundecane, and 3,5-dimethylundecane.

Fuels produced using the method described above exhibited a number of desirable characteristics, including densities from about 0.73-0.76 g/ml, gravimetric net heats of combustion (NHOC) from about 43.91 MJ/kg to about 44.04 MJ/kg, and −20° C. kinematic viscosities from about 2.4-6.3 $mm^2/s$. When compared to a petroleum-based aviation fuel such as Jet-A, the NHOC values for the fuels produced using the method are about 2.9% higher than the lower limit for Jet-A while the low temperature viscosities are up to 70% lower than Jet-A's upper limit.

The fuels can be blended with petroleum-based jet fuels including Jet-A, F-24, and JP-5. The fuels can also be blended with other synthetic paraffinic kerosenes including HEFA-Jet, and jet fuel produced via Fischer-Tropsch catalysis. Fuel blends with cycloalkanes (e.g., 1,4-dimethylcyclooctane, p-menthane, and other isoprene derived cyclodimers) can also be made to generate fuels with higher densities.

In addition to their outstanding jet fuel properties, lightly branched hydrocarbons generated using the method also have potential applications as diesel fuels. Diesel engines ignite fuel through compression in the presence of air. Unlike spark ignition engines, efficient combustion in a diesel engine requires reactive hydrocarbon mixtures with short ignition delays. The ignition delay of hydrocarbons is directly related to their structure in the following order: normal alkanes<branched alkanes and cycloalkanes<aromatic compounds. A key metric of diesel fuel quality is the cetane number, which is inversely proportional to the ignition delay, and proportional to the number of consecutive methylene groups in a hydrocarbon chain. For example, decane has a higher cetane number than nonane, which is higher than octane, and so on. Historically, the cetane number of fuels has been measured with the use of a test engine and fuel standards, but a related value, the derived cetane number (DCN), can be obtained on modest amounts of fuel by measuring the ignition delay of the fuel under specific operating conditions. A lightly branched $C_{10}$-$C_{13}$ fuel mixture generated using the method can exhibit a DCN of 58, which is 18 units higher than that required for Diesel #2 (i.e., greater than 40).

EXAMPLES

The following examples are given as particular embodiments of the invention and to demonstrate the practice and advantages thereof. It is to be understood that the examples are given by way of illustration and are not intended to limit the specification or the claims that follow in any manner.

Methods of Characterization

NMR spectroscopy. $^1$H NMR spectra were recorded on a Bruker Avance III 500 spectrometer at 25° C., operating at 500.46 MHz. Proton-decoupled $^{13}$C NMR spectra were recorded with the same instrument at 25° C., operating at 125.86 MHz. Chemical shifts are reported in parts per million (ppm) downfield from tetramethylsilane and are referenced relative to the NMR solvent ($CDCl_3$), according to the literature values.

Kinematic viscosity and density studies. The kinematic viscosities and densities of the fuels and fuel blendstocks were measured using a Stabinger Viscometer, SVM™ 3001, connected to a TC-502 chiller to achieve temperatures down to −40° C. Each sample was placed in a 5 ml syringe which was then attached to the viscometer through a Luer Lock adapter. Approximately 3 mL of each fuel was then slowly injected to pre-wet the measurement cells. The sample was allowed to equilibrate at the starting temperature (typically 20° C.). The method was then initiated and an additional 1 mL of sample was added. Each sample was then cooled to −40° C. (+0.002° C.), and at 5° C. increments, both the kinematic viscosity and density were measured. Reported values were derived from the average of five determinations. After each run, the measuring cells were rinsed three times with hexanes and dried under a stream of nitrogen.

Heat of Combustion (HOC) Determination. In a typical experiment, a pellet of high-purity benzoic acid (~950-1000 mg) was accurately weighed, and about 350-800 mg of fuel and fuel blendstocks were added and allowed to fully saturate the pellet. The pellet was then re-weighed, and the gross HOC was measured in a Parr 6200 calorimeter. After combustion of the sample, the gross HOC was corrected by subtracting the contribution due to benzoic acid and combusted wire. The net HOC (NHOC) was then calculated from the corrected gross HOC by taking into account the hydrogen content (determined by elemental analysis (EA)) and the density of the fuels and fuel blendstocks at 15° C. The NHOC measurements were taken in triplicate and averaged.

Product Distribution Analysis. Gas chromatography with flame ionization detection (GC-FID) was conducted with an Agilent Technologies 7820A GC system equipped with a DB-5 60 m×0.32 mm×0.25 μm column. The fuel compositions were further analyzed with a Thermo Scientific TRACE™ 1310 gas chromatograph-mass spectrometer (GC-MS) (equipped with an Orbitrap™ mass spectrometer), utilizing a TG-5SilMS 30 mm×0.25 mm×0.25 μm GC column.

Synthesis of Heavier, Acyclic Hydrocarbons

All glassware was dried in an oven at 140° C. prior to use. Dichloromethane was obtained from Fisher Scientific. Diphenylphosphinoethane (DPPE), zinc iodide, 1-pentene, 1-hexene, 1-heptene, and isoprene were obtained from Sigma-Aldrich. 1-octene was obtained from Matheson Co. Inc. Zinc powder was obtained from Alfa Inorganics. Cobalt (II) bromide hexahydrate was obtained from Fisher Scientific and dehydrated by heating to 150° C. under high vacuum (about 0.01 Torr) for an hour, followed by 16 hours under nitrogen. All alkenes were tested for peroxides prior to use (and distilled when necessary) while other chemicals were used as received.

Example 1A. Synthesis of 2-Methyl-5-Methylene-2-Nonene (1a)

$CoBr_2$ (3.281 g, 0.0150 mol) and DPPE (5.956 g, 0.0149 mol) were added to dichloromethane (40 mL) in a Schlenk flask under nitrogen. The resulting solution turned dark brown. Zinc powder (3.9615 g, 0.0606 mol), zinc (II) iodide (19.1109 g, 0.0599 mol), isoprene (150 mL, 1.499 mol), and l-hexene (126.20 g, 1.500 mol) were added to the flask. The resulting mixture was heated at 45° C. and monitored by 1H NMR for completion (about 24 h). The resulting solution was filtered through alumina and purified by vacuum distillation (15 torr, 85° C. bath temperature). 150.77 g (66% yield) of the product were obtained as an 82:18 mixture of 2-methyl-5-methylene-2-nonene (1a): 3-methyl-5-methylenenon-2-ene (1b) (a minor product). 1H NMR (400 MHZ, $CDCl_3$): δ=5.17 (td, J=7.3, 1.1 Hz, 1H), 4.71-4.70 (m, 2H), 2.69 (d, J=7.3 Hz, 2H), 2.03-1.99 (m, 2H), 1.73 (s, 3H), 1.62 (s, 3H), 1.46-1.29 (m, 4H), 0.91 (t, J=7.2 Hz, 3H); 13C NMR (100 MHZ, $CDCl_3$): δ=149.63, 132.85, 122.30, 103.82, 36.03, 35.04, 30.13, 25.89, 22.64, 17.76, 14.15. HRMS (EI): for [M]=$C_{11}H_{20}$ calculated m/z=152.1565, found m/z=152.1558.

Characterization of the minor product: 3-methyl-5-methylenenon-2-ene (1b). 13C NMR (100 MHZ, $CDCl_3$): δ=133.94, 120.69, 109.67, 38.53, 35.72, 30.21, 23.53, 13.63. HRMS (EI): for [M]=$C_{11}H_{20}$ calculated m/z=152.1565, found m/z=152.1559.

Example 1B. Synthesis of 2-methyl-5-methylene-2-nonene (1a) under anhydrous conditions (using 0.1 mol % of a cobalt-based catalyst) $CoBr_2$ (0.0119 g, 0.054 mmol) and DPPE (0.0210 g, 0.053 mmol) were added to dry dichloromethane in a Schlenk flask under nitrogen. The resulting solution turned dark brown. To this was added zinc powder (0.176 g, 2.69 mmol), zinc (II) iodide (0.606 g, 1.90 mmol), isoprene (5 ml, 49.99 mmol), and 1-hexene (6 mL, 47.98 mmol). The resulting mixture was heated at 40° C. and monitored by 1H NMR for completion (about 18 hours). Purification was the same as previously described in Example 1A. 4.8804 g of the product were isolated (64% yield).

Example 2. Synthesis of 2-methyl-5-methylene-2-octene (2a)

2-methyl-5-methylene-2-octene (2a) was synthesized in a similar fashion to that described above in Example 1A using the following quantities of reagents: $CoBr_2$ (0.6330 g, 2.89 mmol), DPPE (1.0459 g, 2.62 mmol), zinc powder (0.8451 g, 12.9 mmol), zinc (II) iodide (3.7012 g, 11.6 mmol), isoprene (31 mL, 310 mmol), and 1-pentene (20.9801 g, 299 mmol). The resulting solution was filtered over alumina and purified by vacuum distillation (about 0.5 torr, 60° C. bath temperature) to provide 28.1526 g of the product (68% yield) as a mixture of 75:25 ratio of 2-methyl-5-methylene-2-octene (2a): 3-methyl-5-methyleneoct-2-ene (2b) (a minor product). 1H NMR (400 MHZ, $CDCl_3$): δ=5.20-5.16 (m, 1H), 4.71 (m, 2H), 2.69 (d, J=7.3 Hz, 2H), 1.99 (t, J=7.7 Hz, 2H), 1.73 (s, 3H), 1.62 (s, 3H), 1.49-1.44 (m, 2H), 0.91 (t, J=7.3 Hz, 3H); 13C NMR (100 MHz, $CDCl_3$): δ=149.36, 132.85, 122.30, 108.99, 38.49, 35.01, 25.89, 21.01, 17.75, 14.01. HRMS (EI): for [M]=$C_9H_{18}$ calculated m/z=138.14085, found m/z=138.14030.

Characterization of the minor product: 3-methyl-5-methyleneoct-2-ene (2b). 13C NMR (100 MHZ, $CDCl_3$): δ=147.18, 133.94, 120.69, 109.83, 38.17, 23.54, 13.61; HRMS (EI): for [M]=$C_9H_{18}$ calculated m/z=138.14085, found m/z=138.14049.

Example 3. Synthesis of 2-methyl-5-methylene-2-decene (3a)

2-methyl-5-methylene-2-decene (3a) was synthesized as described above in Example 1A using the following quantities of reagents: $CoBr_2$ (0.4493 g, 2.05 mmol), DPPE (0.7991 g, 2.01 mmol), zinc powder (0.5651 g, 8.64 mmol), zinc (II) iodide (2.5515 g, 7.99 mmol), isoprene (20 mL, 200 mmol), and 1-heptene (19.5512 g, 199 mmol). The resulting solution was filtered alumina and purified by vacuum distillation (<0.5 torr, 70° C. bath temperature) to provide 20.8355 g (63% yield) of the product as a 91:9 ratio of 2-methyl-5-methylene-2-decene (3a): 3-methyl-5-methylenedec-2-ene (3b) (a minor product). 1H NMR (400 MHZ, $CDCl_3$): δ=5.20-5.16 (m, 1H), 4.71-4.70 (m, 2H), 2.69 (d, J=7.3 Hz, 2H), 2.00 (t, J=7.7 Hz, 2H), 1.73 (s, 3H), 1.64-1.62 (m, 3H), 1.48-1.40 (m, 2H), 1.36-1.25 (m, 4H), 0.90 (t, J=7.0 Hz, 3H); 13C NMR (100 MHz, $CDCl_3$): δ=149.63, 132.85, 122.30, 108.82, 36.03, 35.04, 30.13, 25.89, 22.64, 17.76, 14.15. HRMS (EI): for [M]=$C_{12}H_{22}$ calculated m/z=166.17215, found m/z –166.17142.

Characterization of the minor product: 3-methyl-5-methylenedec-2-ene (3b). 13C NMR (100 MHZ, $CDCl_3$): δ=147.90, 133.92, 120.69, 109.67, 38.51, 27.66, 23.54, 13.64. HRMS (EI): for [M]=$C_{12}H_{22}$ calculated m/z=166.17215, found m/z=166.17151.

Example 4. Synthesis of 2-methyl-5-methylene-2-undecene (4a)

2-methyl-5-methylene-2-undecene (4a) was synthesized as described above in Example 1A using the following quantities of reagents: $CoBr_2$ (0.4325 g. 1.98 mmol), DPPE (0.7949 g. 1.99 mmol), zinc powder (0.5462 g. 8.35 mmol), zinc (II) iodide (2.5509 g. 7.99 mmol), isoprene (20 mL, 200 mmol), and 1-octene (22.4751 g, 200 mmol). The resulting solution was filtered over alumina and purified by vacuum distillation (<0.5 torr, 100° C. bath temperature) to provide 30.3704 g of product (84% yield). 1H NMR (400 MHZ, $CDCl_3$): δ=5.16 (t, 1H), 4.69-4.68 (m, 2H), 2.67 (d, J=7.3 Hz, 2H), 1.99 (t, J=7.7 Hz, 2H), 1.72 (s, 3H), 1.63-1.62 (m, 3H), 1.48-1.39 (m, 2H), 1.36-1.21 (m, 6H), 0.88 (m, 3H); 13C NMR (100 MHZ, $CDCl_3$): δ=149.66, 132.83, 122.31, 108.83, 36.36, 35.04, 31.95, 29.25, 27.89, 25.89, 22.80, 17.76, 14.24. HRMS (EI): for [M]=$C_{13}H_{24}$ calculated m/z=180.18780, found m/z=180.18733.

Characterization of the minor product: 3-methyl-5-methyleneundec-2-ene (4b). 13C NMR (100 MHZ, $CDCl_3$): δ=147.49, 133.93, 120.69, 109.67, 38.52, 36.04, 28.99, 27.96, 23.53, 13.63; HRMS (EI): for [M]=$C_{13}H_{24}$ calculated m/z=180.18780, found m/z=180.18738.

Example 5. Synthesis of a Mixed Fuel Precursor Mixture (5)

$CoBr_2$ (0.4329 g, 1.98 mmol) and DPPE (0.7983 g, 2.00 mmol) were added to dichloromethane in a Schlenk flask under nitrogen. To the resulting solution was added, successively, zinc iodide (2.6445 g, 8.28 mmol), zinc (0.5554 g, 8.49 mmol), 1-octene (5.6457 g, 50.31 mmol), 1-heptene (4.9582 g, 50.50 mmol), 1-hexene (4.2401 g, 50.38 mmol), 1-pentene (3.5564 g, 50.71 mmol), and isoprene (21 mL, 209.9 mmol). A reflux condenser chilled to 2° C. was attached to the flask, and the reaction was heated at 45° C. and monitored for completion by 1H NMR (about 20 hours). On completion, the reaction was decanted off the solids, and the solvent was removed on the rotary evaporator. The remaining liquid was dissolved in hexanes and filtered through a silica plug. The solvent was removed under reduced pressure to isolate 19.77 g of the crude fuel product (62% yield). Anal. Calc. for $C_{15}H_{21}$: C, 84.56; H, 15.44. Found: C, 84.74; H, 15.57.

Hydrogenation of Heavier, Acyclic Hydrocarbons

For Examples 7-11 below, a substrate (i.e., a heavier, acyclic hydrocarbon) selected from those produced in Examples 1A-5 was added to a Parr bomb, along with acetic acid (1 mL per 10 g substrate) and 10% Pd/C (1 g per 100 g substrate). Due to the use of a phosphine catalyst in the previous step, careful purification of the starting material is required to ensure that all traces of the phosphine have been removed. The bomb was purged with hydrogen, pressurized to 650 psi, and then heated to 200° C. until the reaction was complete as determined via NMR. Reactions were typically allowed to proceed overnight (for about 10-18 hours). The bomb was then cooled, and the acid was neutralized with aqueous sodium bicarbonate. The mixture was filtered over Celite and the layers of organic material generated were separated. The water layer was extracted with diethyl ether (3×50 mL), dried, and the solvent removed under reduced pressure. The resulting oil was distilled from calcium hydride to yield analytically pure fuel products.

Example 7. 2,5-dimethylnonane (F1)

Substrate: 2-methyl-5-methylene-2-nonene (1a) (and 3-methyl-5-methylenenon-2-ene (1b)) of Example 1A. 80% yield; 87:13 ratio of 2,5-dimethylnonane to 3,5-dimethylnonane by quantitative carbon NMR. 1H NMR (400 MHz, $CDCl_3$): δ=1.47 (m, 1H), 1.25 (m, 7H), 1.11 (m, 3H), 0.86 (m, 13H); 13C NMR (100 MHz, $CDCl_3$): δ=36.95, 36.54, 34.54, 33.16, 29.52, 28.50, 23.23, 23.00, 22.77, 19.91, 14.36. HRMS (EI): for [M]=$C_{13}H_{24}$ calculated m/z=156.18780, found m/z=156.17902; Anal. Calc. for $C_{13}H_{24}$: C, 84.52; H, 15.48. Found: C, 84.59; H, 15.48.

Characterization of the minor product: 3,5-dimethylnonane. $^{13}C$ NMR (100 MHz, $CDCl_3$): δ=44.68, 37.88, 31.93, 30.59, 30.23, 30.18, 29.39, 19.70.

Example 8. 2,5-dimethyloctane (F2)

Substrate: 2-methyl-5-methylene-2-octene (2a) (and 3-methyl-5-methyleneoct-2-ene (2b)) of Example 2. 65% yield; 89:11 ratio of 2,5-dimethyloctane to 3,5-dimethyloctane by quantitative carbon NMR. $^1H$ NMR (400 MHZ, $CDCl_3$): δ=1.53-1.43 (m, 1H), 1.39-1.11 (m, 9H), 0.91-0.80 (m, 12H); 13C NMR (100 MHz. $CDCl_3$): δ=39.16, 36.57, 34.95, 32.94, 28.52, 22.98, 22.76, 20.33, 19.57, 14.58. Anal. Calc. for $C_{10}H_{22}$: C, 84.42; H, 15.58. Found: C, 84.67; H, 15.63.

Characterization of the minor product: 3,5-dimethyloctane. 13C NMR (100 MHZ, $CDCl_3$): δ=44.93, 44.68, 40.50, 39.44, 31.94, 31.79, 30.59, 29.98, 29.43, 20.43, 20.18, 19.66, 19.18, 11.60, 11.36.

Example 9. 2,5-dimethyldecane (F3)

Substrate: 2-methyl-5-methylene-2-decene (3a) (and 3-methyl-5-methylenedec-2-ene (3b)) of Example 3. 82% yield; 91:9 ratio of 2,5-dimethyldecane to 3,5-dimethyldecane by quantitative carbon NMR. $^1$H NMR (400 MHZ, $CDCl_3$): δ=1.54-1.42 (m, 1H), 1.38-1.20 (m, 9H), 1.20-1.01 (m, 3H), 0.91-0.80, (m, 13H); 13C NMR (100 MHZ, $CDCl_3$): δ=37.22, 36.57, 34.94, 33.19, 32.44, 28.51, 26.93, 22.99, 22.89, 22.76, 19.91, 14.28. Anal. Calc. for $C_{12}H_{26}$: C, 84.62; H, 15.38. Found: C, 84.64; H, 15.41.

Characterization of the minor product: 3,5-dimethyldecane. 13C NMR (100 MHZ, $CDCl_3$): δ=32.01, 31.93, 30.25, 29.88.

Example 10. 2,5-dimethylundecane (F4)

Substrate: 2-methyl-5-methylene-2-undecene (4a) (and 3-methyl-5-methyleneundec-2-ene (4b)) from Example 4. 81% yield; 90:10 ratio of 2,5-dimethylundecane to 3,5-dimethylundecane by quantitative carbon NMR. 1H NMR (400 MHZ, $CDCl_3$): δ=1.51-1.43 (m, 1H), 1.37-1.21 (m, 12H), 1.19-1.03 (m, 3H), 0.91-0.82 (m, 12H); 13C NMR (100 MHz, $CDCl_3$): δ=37.29, 36.56, 34.94, 33.19, 32.14, 29.89, 28.51, 27.23, 22.99, 22.87, 22.76, 19.92, 14.29; Anal. Calc. for $C_{13}H_{28}$: C, 84.69; H, 15.31. Found: C, 84.68; H, 15.36.

Characterization of the minor product: 3,5-dimethylundecane. 13C NMR (100 MHZ, $CDCl_3$): δ=44.92, 44.68, 38.20, 37.10, 31.93, 31.77, 30.60, 30.25, 30.21, 29.41, 27.09, 20.46, 19.70, 19.18, 11.62, 11.38.

Example 11. Mixed Fuel (F5)

Substrate: Mixed fuel precursor mixture (5) of Example 5. 78% yield. 1H NMR (400 MHZ, $CDCl_3$): δ=1.51-1.41 (m, 1H), 1.35-1.00 (m), 0.93-0.79 (m). 13C NMR (100 MHz, $CDCl_3$): δ=44.92, 44.68, 39.62, 37.31, 37.25, 36.98, 36.58, 34.96, 33.21, 32.94, 32.46, 32.16, 31.94, 31.78, 30.59, 29.90, 29.54, 29.41, 28.52, 27.25, 26.95, 23.24, 22.99, 22.90, 22.77, 20.46, 20.33, 19.92, 19.70, 19.18, 14.58, 14.34, 14.29, 11.61, 11.37. Anal. Calc. for $C_{11.5}H_{25}$: C, 84.56; H, 15.57. Found: C, 84.74; H, 15.57.

Evaluation of Hydrogenated Acyclic Hydrocarbons

The cobalt catalyst proved to be robust, and hydrovinylation reactions could be conducted with 1 mol % catalyst loadings in standard grade solvents. However, the reaction was quite sensitive to small amounts of peroxides in the alkene substrates, requiring the use of a fresh α-olefins, or distillation of the α-olefins, prior to use. To see if the catalyst loading could be reduced further, a reaction was conducted with 0.1 mol % loading using anhydrous $CH_2C_{12}$ and freshly distilled alkene substrates. The reaction proceeded in a similar fashion to the reactions conducted with 1 mol % loading showing a 10-fold increase in turnover number (TON) when proper precautions were taken. In all cases, complete conversion of the starting alkenes was observed and distilled yields of the products ranged from about 65% to nearly 90%. In addition to the good yields of mixed alkenes produced via this approach, utilizes zinc as a mild reductant, unlike other methods which utilize toxic mercury containing reducing agents (sodium amalgam).

Figure 5:
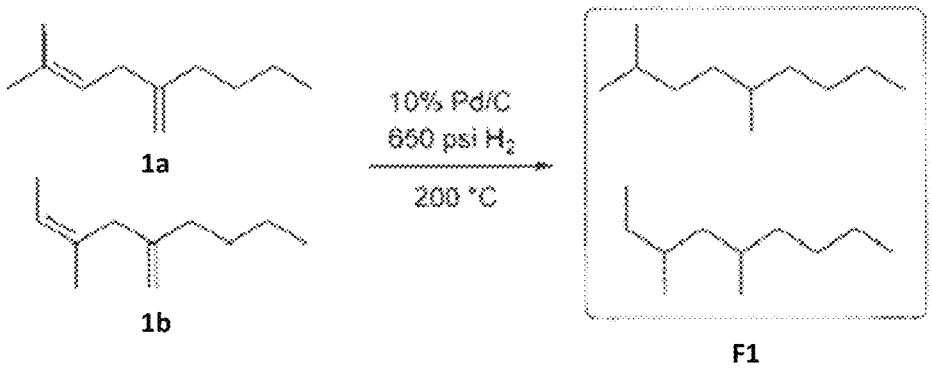
FIG. 5 is a schematic depicting an example of hydrogenation of acyclic hydrocarbon products of the hydrovinylation of isoprene and 1-hexene.

The 2-methyl-5-methylene-2-nonene (1a) (and 3-methyl-5-methylenenon-2-ene (1b)) produced in Example 1A were hydrogenated with a 10% Pd/C catalyst to prepare a jet fuel blendstock, 2,5-dimethylnonane (and 3,5-dimethylnonane) (F1) of Example 7, as depicted in FIG. 5. Hydrogenation of the heavier, acyclic hydrocarbons of Example 1A proved more challenging because little hydrogen uptake was observed at about 500 psi, even when the temperature was raised to about 150° C. However, elevating the temperature to about 200° C. and increasing the hydrogen pressure to greater than about 650 psi allowed for the efficient conversion of the heavier, acyclic hydrocarbons of Example 1A to our desired product, 2,5-dimethylnonane (F1), in an about 80% distilled yield.

Figure 6:
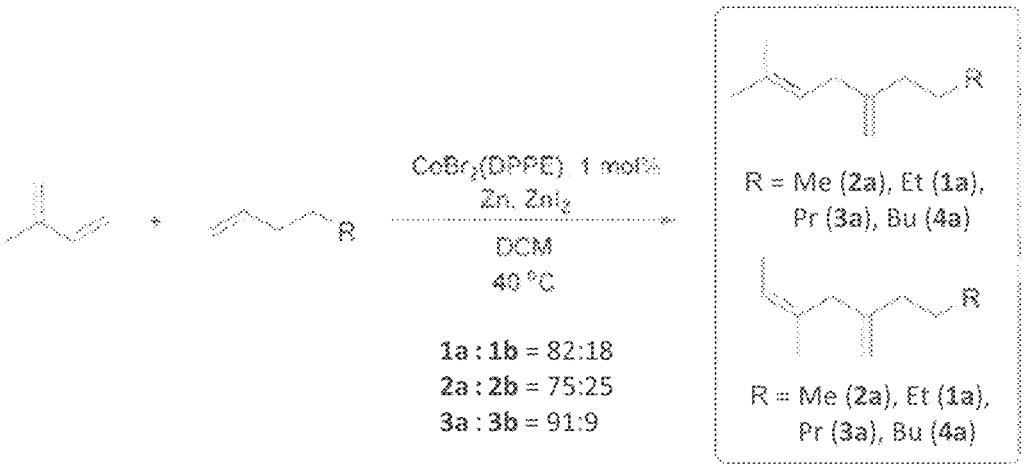
FIG. 6 is a schematic depicting an example e of the hydrovinylation of isoprene with $C_5$, $C_6$, $C_7$, and $C_8$ alkenes.

When reacting 1-pentene, 1-heptene, and 1-octene with isoprene under the conditions used for 1-hexene, the results were similar to that obtained with 1-hexene, resulting in the isolation of the heavier, acyclic hydrocarbons produced in Example 2, 3, and 4 (2-methyl-5-methylene-2-octene (2a), 2-methyl-5-methylene-2-decene (3a), and 2-methyl-5-methylene-2-undecene (4a), respectively) as depicted in FIG. 6. Also, the similar type of side-product was generated that was observed for 1-hexene (3-methyl-5-methyleneoct-2-ene (2b), 3-methyl-5-methylenedec-2-ene (3b), and 3-methyl-5-methyleneundec-2-ene (4b)). The conditions established for the hydrogenation of the 2-methyl-5-methylene-2-nonene (1a) produced in Examples 1A proved applicable to the heavier, acyclic hydrocarbons of Example 2, 3, and 4, allowing us to obtain high yields of all our desired fuel products of Examples 8, 9, and 10 2,5-dimethyloctane (F2), 2,5-dimethyldecane (F3), and 2,5-dimethylundecane (F4)).

Figure 7:
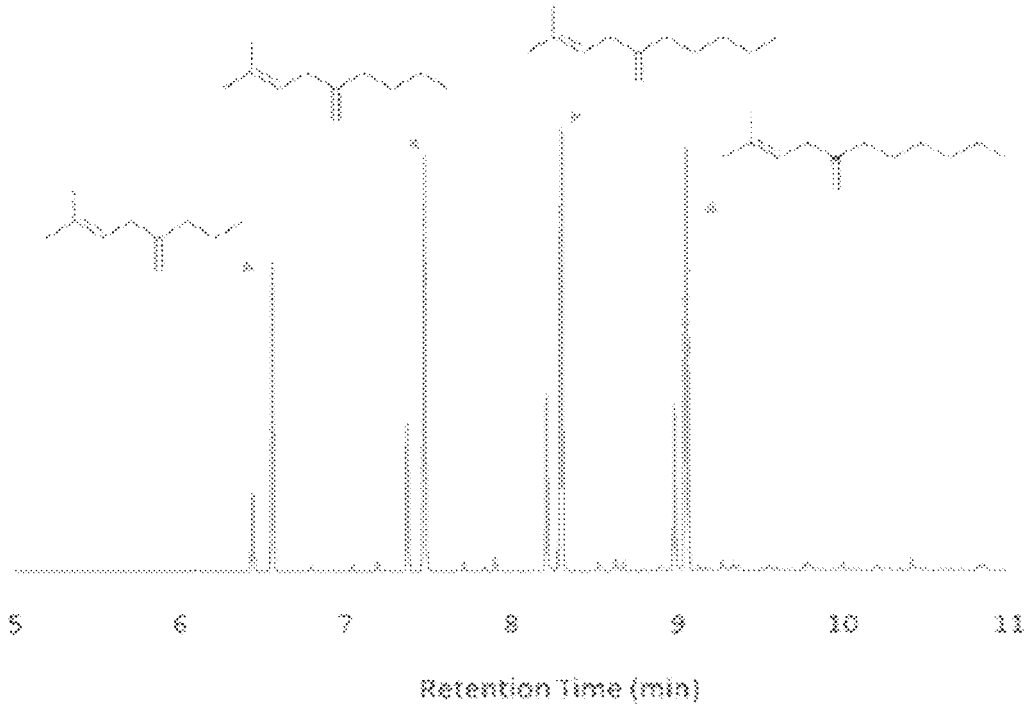
FIG. 7 is a gas chromatogram of the hydrovinylation products from the mixed reaction of isoprene with 1-pentene, 1-hexene, 1-heptene, and 1-octene.

The hydrovinylation of a mixed feed of alkenes in Example 5 (i.e., equimolar amounts of 1-pentene, 1-hexene, 1-heptene and 1-octene were combined with the cobalt catalyst and enough isoprene to couple with all of the α-olefins) produced a fuel mixture of $C_{10}$-$C_{13}$ hydrocarbons after purification (by distillation) and hydrogenation. A gas chromatograph of the products of the hydrovinylation reaction of isoprene with 1-pentene, 1-hexene, 1-heptene, and 1-octene is shown in FIG. 7. The broad distillation range is reminiscent of existing SAF blends like those conventionally derived by hydrotreating fatty acids and esters (e.g., HEFA-Jet).

To evaluate the utility of the saturated hydrocarbon mixtures as jet fuel blendstocks produced in Examples 7-11, the density, kinematic viscosity, and gravimetric/volumetric net heats of combustion (NHOC) of the fuels and fuel blendstock of Examples 7-11 were measured and compared to conventional fuels, such as HEFA-Jet and Jet-A, as shown in Table 1 below.

TABLE 1

| Fuel | Density, ρ (15° C., g/mL) | NHOC (MJ/kg) | NHOC (MJ/L) | Viscosity, η (−20° C., mm$^2$/s) | Viscosity, η (−40° C., mm$^2$/s) |
|---|---|---|---|---|---|
| F2 | 0.734 | 43.91 | 32.22 | 2.17 | 3.60 |
| F1 | 0.744 | 44.05 | 33.02 | 3.17 | 5.94 |
| F3 | 0.752 | 44.02 | 33.10 | 4.49 | 9.38 |
| F4 | 0.759 | 43.91 | 33.32 | 6.32 | 14.35 |
| F5 | 0.750 | 44.04 | 33.03 | 3.88 | 7.67 |
| 2,6-DMO | 0.733 | 43.98 | 32.26 | — | 3.83 |
| 5-MU | 0.755 | 43.83 | 33.12 | 4.84 | 10.47 |
| HEFA-Jet | 0.762 | 43.73 | 33.30 | 5.65 | 12.77 |
| Jet-A | >0.775 | >42.8 | >33.2 | <8.0 | <12.0 |

The densities of the different fuel mixtures ranged from about 0.73-0.76 g/mL, with values increasing based on the molecular weights of the components. The blend or hydrogenated hydovinylation products, the mixed fuel (F5) of Example 11, had a density of 0.750 g/mL, intermediate between that of 2,5-dimethylnonane (F1) and 2,5-dimethyldecane (F3) produced in Examples 7 and 9, respectively.

Although the densities of the hydrovinylation fuels are lower than the minimum density of Jet-A (0.775 g/mL), they are consistent with the requirements for synthetic paraffinic kerosenes described in ASTM D7566, which outlines specifications for aviation turbine fuels containing synthesized hydrocarbons. For example, as specified in ASTM D7566, fuels produced via Fischer-Tropsch catalysis can have densities ranging from 0.73-0.77 g/mL while fuels produced by hydrotreatment of fatty acids and esters such as HEFA-Jet can have densities ranging from 0.73-0.77 g/mL.

The gravimetric NHOC of the heavier, acyclic hydrocarbon fuels produced in Examples 7-11 were exceptional, ranging from 43.91-44.04 MJ/kg as shown in Table 1. These values are about 2.9% higher than the lower limit for Jet-A, which translates into greater range for commercial aircraft using the same amount of fuel on a mass basis. The small differences between the NHOC of the heavier, acyclic hydrocarbon fuels are likely due to subtle differences in purity and not the molecular composition of each fuel. Shorter chain hydrocarbons with increased mass percents of hydrogen would be expected to have higher gravimetric NHOC, but no such trend is observed in this case. The higher NHOC of fuels produced in Examples 7-11 compared to Jet-A are likely due to the lack of aromatic compounds and cycloalkanes, which have lower heats of combustion as a result of the reduced amount of hydrogen in the fuel molecules.

The kinematic viscosities of the heavier, acyclic hydrocarbon fuels of Examples 7-11 ranged from about 2.37 $mm^2/s$ to about 6.32 $mm^2/s$ at −20° C. These values are well within the specification for Jet-A (<8.0 $mm^2/s$) and, in the case of the $C_{10}$ blendstock (2,5-dimethyloctane (F2)), approximately 70% lower than the limit for Jet-A. At −40° C., the viscosity of the $C_{10}$-$C_{12}$ fuels produced in Examples 7-9, as well as the mixed fuel (F5) of Example 11, ranged from about 3.99 $mm^2/s$ to about 9.38 $mm^2/s$, consistent with the desired range for JetA (<12.0 $mm^2/s$). In contrast, the −40° C. kinematic viscosity of 2,5-dimethylundecane (F4) (a $C_{13}$ fuel) was higher than the limit for Jet-A due to its higher molecular weight. The kinematic viscosity of the mixed fuel (F5) was intermediate between that of 2,5-dimethyloctane (F2) and 2,5-dimethyldecane (F3).

With respect to the utility of these heavier, acyclic hydrocarbon fuels for diesel applications, it was determined that the derived cetane number (DCN) of 2,5-dimethylnonane (F1) was 53, a value that is 13 units higher than that required for Diesel #2 which is a DCN greater than 40. 2,5-dimethylnonane (F1) is a mixture of Cu compounds, each with two branch sites and a chain length of nine carbons. The DCN of 2,5-dimethylnonane (F1) can be compared to that of n-nonane with a reported value of 61. This result shows that the two methyl branches in 2,5-dimethylnonane (F1) have only a minor negative impact on the ignition delay. 2,5-dimethylnonane (F1) can also be compared to 5-methylundecane (5-MU), a SAF blendstock that can be generated from ethanol by dehydration and controlled oligomerization. 5-MU is a $C_{12}$ hydrocarbon with a single methyl branch site and has a DCN of 67. In addition to 2,5-dimethylnonane (F1), we measured the DCN of the mixed fuel (F5). The mixed fuel (F5) exhibited a slightly higher DCN of 58 due to the higher average chain length (nominally about 9.5) of the hydrocarbons composing the blend. Overall, the heavier, acyclic hydrocarbon fuels show great promise as potential diesel fuel blendstocks. Table 2 below compares the DCN values for the heavier, acyclic hydrocarbon fuels produced using the method described above to that of conventional diesel fuels.

TABLE 2

| Fuel | Derived Cetane Number (DCN) | Molecular Composition |
|---|---|---|
| F1 | 53 | acyclic, $C_{11}H_{24}$, 2 branch sites |
| F5 | 58 | acyclic, $C_{11.5}H_{25}$, 2 branch sites |
| n-nonane | 61 | acyclic, $C_9H_{20}$, no branching |
| 5-MU | 67 | acyclic, $C_{12}H_{26}$, 1 branch sites |
| 2,6-DMO | 52 | acyclic, $C_{10}H_{22}$, 2 branch sites |
| p-methane | 29 | cyclic, $C_{10}H_{20}$, 3 branch sites |
| Diesel #2 | >40 | complex mixture of cyclic, acyclic, and aromatic hydrocarbons |

What is claimed is:

1. A method for converting isoprene and α-olefins to one or more acyclic hydrocarbon fuels or fuel blendstocks, the method comprising:

providing isoprene and at least one α-olefin, wherein a molar ratio of the isoprene to the at least one α-olefin is from about 1:0.96 to about 1:1;

hydrovinylizing the isoprene and the at least one α-olefin to generate an acyclic hydrocarbon product by heating the isoprene and the at least one α-olefin at a temperature ranging from about 40° C. to about 45° C. in the presence of a first catalyst for about 18 hours to about 24 hours; and hydrogenating the acyclic hydrocarbon product by heating the acyclic hydrocarbon product at a temperature of about 200° C. in the presence of a second catalyst for about 16 hours under a pressure of hydrogen of about 650 psi, thereby producing at least one fuel or fuel blendstock having a density of about 0.73 g/ml to about 0.76 g/ml, a gravimetric net heat of combustion from about 43.91 MJ/kg to about 44.05 MJ/kg, and a kinematic viscosity at −20° C. from about 2.4 $mm^2/s$ to about 6.3 $mm^2/s$.

2. The method of claim 1, wherein the isoprene is derived from biological sources.

3. The method of claim 1, wherein the at least one «-olefin is derived from biological sources.

4. The method of claim 3, wherein the at least one α-olefin is selected from the group consisting of 1-propene, 1-butene, 1-pentene, 1-hexene, 1-heptene, 1-octene, 1-nonene, 1-decene, 1-undecene, 1-dodecene, and combinations thereof.

5. The method of claim 1, wherein the hydrovinylation of the isoprene and the at least one α-olefin comprises:

the at least one α-olefin undergoing 1,4-addition to the isoprene with coupling through the 2-position of the least one α-olefin; and the first catalyst comprises one or more transition metal catalysts.

6. The method of claim 5, wherein the one or more transition metal catalysts is present in an amount of about 0.1 mole percent.

7. The method of claim 5, wherein the one or more transition catalysts comprises a catalyst having a cobalt metal center ligated with phosphine ligands.

8. The method of claim 7, wherein the one or more transition metal catalyst is reduced with a zinc metal.

9. The method of claim 7, wherein the catalyst having a cobalt metal center ligated with phosphine ligands is a cobalt (II) bromide DPPE complex.

10. The method of claim 1, wherein the hydrovinylation of the isoprene and the at least one α-olefin comprises one or more standard grade solvents.

11. The method of claim 10, wherein the one or more standard grade solvents is dichloromethane.

12. The method of claim 1, wherein the second catalyst is a catalyst based on nickel, iron, cobalt, platinum, or palladium.

13. The method of claim 12, wherein the catalyst is a palladium-carbon (Pd/C) catalyst.

14. The method of claim 1, wherein the method further comprises purifying the acyclic hydrocarbons directly after hydrogenating the acyclic hydrocarbons, thereby producing at least one, purified fuel or fuel blendstock.

15. The method of claim 14, wherein purifying the acyclic hydrocarbons comprises distilling the acyclic hydrocarbons.

* * * * *